US005958484A

United States Patent [19]

Gics

[11] Patent Number: 5,958,484

[45] **Date of Patent: *Sep. 28, 1999**

[54] FOOD PACKAGE INCLUDING A TRAY SURROUNDED BY A SLEEVE HAVING AN END FLAP

[75] Inventor: Paul W. Gics, Sewickley Heights, Pa.

[73] Assignee: Gics & Vermee, L.P., Sewickley, Pa.

[ * ] Notice: This patent is subject to a terminal disclaimer.

[21] Appl. No.: 08/958,920

[22] Filed: Oct. 28, 1997

[51] Int. Cl.[6] ..... B65D 1/34

[52] U.S. Cl. ..... 426/122; 426/124; 426/87; 426/113; 426/398; 206/462; 220/635

[58] Field of Search ..... 426/122, 124, 426/106, 113, 398, 87; 220/631, 635; 206/461, 462, 779, 784, 769

[56] References Cited

U.S. PATENT DOCUMENTS

| | | | |
|---|---|---|---|
| 3,126,660 | 3/1964 | Meyers | 40/312 |
| 3,412,889 | 11/1968 | Eicholtz et al. | 220/60 |
| 3,495,758 | 2/1970 | Wienecke, Jr. | 229/43 |
| 3,785,544 | 1/1974 | Smith | 229/14 |
| 3,904,104 | 9/1975 | Kane | 229/3.5 |
| 3,938,730 | 2/1976 | Detzel et al. | 206/525 |
| 4,801,017 | 1/1989 | Artusi | 206/524.1 |
| 4,870,233 | 9/1989 | McDonald et al. | 219/10.55 E |
| 4,939,332 | 7/1990 | Hahn | 219/10.55 E |
| 5,011,006 | 4/1991 | Anderson | 206/45.24 |
| 5,090,615 | 2/1992 | Hopkins et al. | 229/125.35 |
| 5,119,940 | 6/1992 | Grindrod | 206/45.31 |
| 5,234,159 | 8/1993 | Lorence et al. | 229/125.35 |
| 5,370,883 | 12/1994 | Sannier | 426/107 |
| 5,484,984 | 1/1996 | Gics | 219/734 |
| 5,492,703 | 2/1996 | Gics | 426/87 |
| 5,709,308 | 1/1998 | Gics | 206/557 |
| 5,743,402 | 4/1998 | Gics | 206/459.5 |

FOREIGN PATENT DOCUMENTS 8604880 8/1986 WIPO .

*Primary Examiner*—David Lacey
*Assistant Examiner*—Hao Mai
*Attorney, Agent, or Firm*—David V. Radack; Eckert Seamans Cherin & Mellott, LLC

[57] ABSTRACT

A food package including a tray and a sleeve surrounding the tray where the sleeve includes at least one end flap extending therefrom and mechanically secured to the tray. In this way, the tray may be effectively retained within the sleeve. The at least one end flap also provides for increased structural integrity of the sleeve.

20 Claims, 6 Drawing Sheets

FOOD PACKAGE INCLUDING A TRAY SURROUNDED BY A SLEEVE HAVING AN END FLAP

BACKGROUND OF THE INVENTION

This invention relates to a food package including a tray surrounded by a sleeve having an end flap.

Packaging for food items typically involves providing a styrofoam tray on which the food product is supported and which is then wrapped by a plastic wrap. There are several disadvantages with this package, such as, for example, the package may tend to leak and may not provide sufficient labeling space. To overcome this problem, my U.S. Pat. No. 5,492,703 provides a food package including a food package tray partially surrounded by a food package jacket. With this package, there is a separate lid and a separate jacket that each must be secured to the food package tray. The jacket is secured to the food package tray as a result of side flaps of the jacket being sealed to a flange portion of the food package tray. Similarly, U.S. Pat. No. 4,801,017 provides a food container including a food package tray surrounded by a jacket. With this package, the jacket includes side flaps and end flaps which are also sealed to the rim of the food package tray. This food packages also fail to provide sufficient labeling space.

Commonly owned U.S. patent application Ser. No. 08/819,889, filed Mar. 18, 1997, (now U.S. Pat. No. 5,743, 402)discloses a food package including a tray and sleeve. The sleeve is disposed about the tray and provides an attractive facing and sufficient labeling space.

What is needed, therefore, is a food package which provides a sleeve disposed about a tray where the tray can be conveniently retained within the sleeve.

SUMMARY OF THE INVENTION

The food package of the present invention has met or exceeded the above-mentioned needs, as well as others. The food package comprises a tray including a base and a sidewall extending from the base. At least a portion of the sidewall includes a flange extending therefrom. The food package further comprises a sleeve surrounding the tray, the sleeve including at least one end flap extending therefrom. The at least one end flap is mechanically secured to the flange. Advantageously, the at least one end flap improves the structural integrity of the sleeve which surrounds the tray while also providing a means for retaining the tray within the sleeve.

BRIEF DESCRIPTION OF TIE DRAWINGS

A full understanding of the invention can be gained from the following detailed description of the invention when read in conjunction with the accompanying drawings in which.

DETAILED DESCRIPTION

Figure 1:
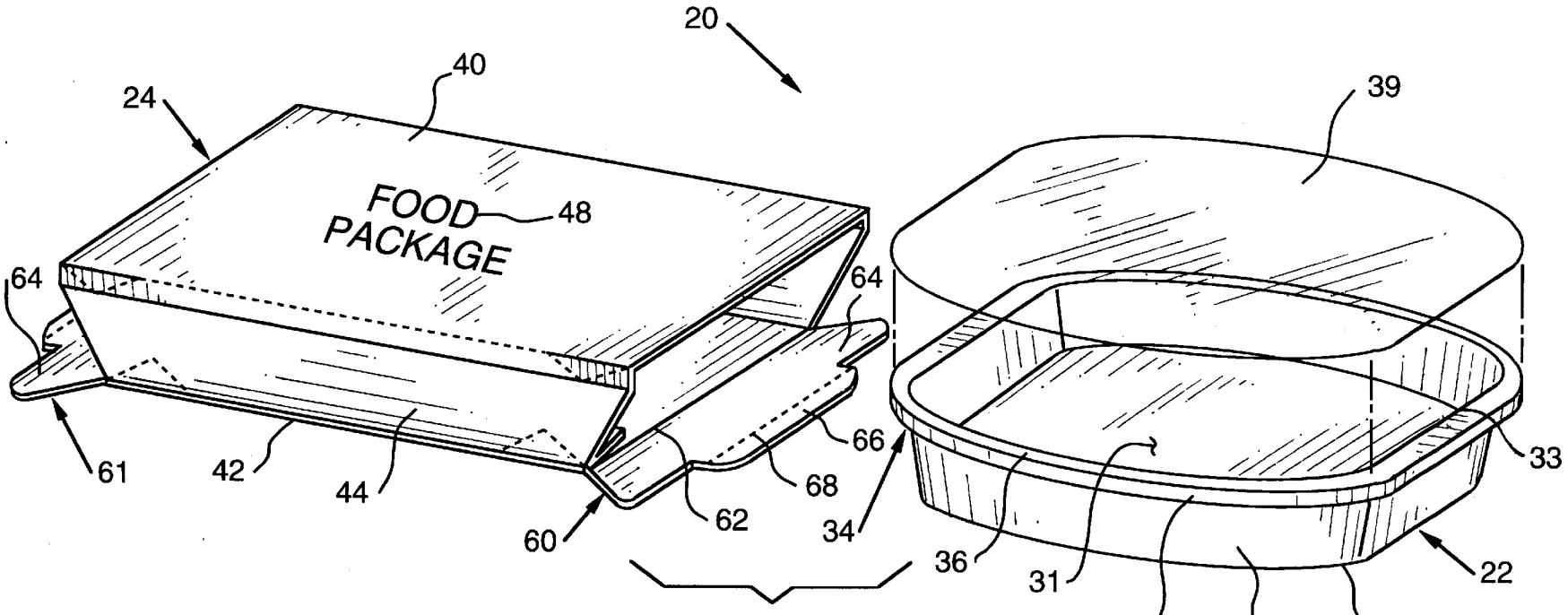
FIG. 1 is an exploded perspective view of one embodiment of the food package of the present invention.

As used herein, the term "mechanically secured" or variations thereof refers to any known type mechanical fastening means, but does not refer to any type of chemical bonding or adhesive sealing.

Referring now to FIGS. 1–5, a preferred embodiment of a food package 20 of the present invention is shown. The food package 20 consists of a tray 22 and a sleeve 24. The tray 22 can be made of any suitable material, however, it is preferred that the tray 22 be made of a plastic. Most preferably, the plastic is crystallized polyethylene terephlalate ("C-PETE") although other plastics, such as, amorphus polyethylene terephlalate ("A-PETE") or polypropylene may be used. The sleeve 24 can also be made of any suitable material, but preferably is made of paperboard.

The plastic tray 22 has a base 30 and a sidewall 32 extending from the base 30. The sidewall 32 of tray 22 terminates in a free edge 33 which defines a tray opening 31. It will be appreciated that tray 22 may be of the shape as shown in FIGS. 1–5 or any other shape, such as, rectangular, oval, or circular depending on both functional and aesthetic requirements. The sidewall 32 includes a flange 34 having a first section 36 extending generally perpendicularly from the sidewall 32 and a second section 38 extending generally perpendicularly from the first section 36. Tray 22 may also include a plastic film 39 in sealing engagement therewith, as is known.

It is preferred that the plastic tray 22 be integrally formed by a molding process, although the tray 22 may be made as separate components and secured together in order to form the tray 22. Although flange 34 is shown as extending from an outer portion of the free edge 33 of sidewall 32, it will be appreciated that flange 34 may be positioned and extend from sidewall 32 at any point along the height of sidewall 32.

The sleeve 24 includes a front panel 40 and a back panel 42. Sleeve 24 also includes a pair of sidewall members 44,46 extending between the front panel 40 and the back panel 42. Tear strip 41 may be provided between sidewall member 44 and front panel 40, or other similar location, so that sidewall member 44 and front panel 40 may be separated and exposing tray 22. Indicia such as the words "FOOD PACKAGE" 48 may be printed or otherwise disposed on the front panel 40. It will be appreciated that the indicia can also include pleasing graphics or colors to make the package 20 more attractive to a potential consumer. In addition, back panel 42 may be used to place other indicia, such as "NUTRITIONAL INFORMATION" 50, which may be mandated by local food labeling laws, as well as, "COOKING INSTRUCTIONS" 52, which may be desired to be placed on the food package 20 (see FIG. 5). In this way, the more prosaic information either required or desired to be placed on the sleeve 24 can be printed on the back panel 42, leaving the front panel 40 free for containing more eye-catching graphics and colors.

In accordance with an important aspect of the present invention, sleeve 24 includes end flaps 60,61. End flaps 60,61 preferably extend from the back panel 42 and are separated therefrom by bend lines 62,63, respectively. The bend lines 62,63 allow for the end flaps 60,61 to be movable with respect to back panel 42, as illustrated by arrows A in FIG. 4. Advantageously, this allows for end flaps 60,61 to be mechanically secured to the flange 34 of tray 22, as will be described in more detail herein. End flap 60 includes an end wall portion 64 and an edge strip 66 which is separated from end wall portion 64 by score line 68. As will be appreciated, edge strip 66 is movable with respect to end wall portion 64, as illustrated by arrows B in FIG. 4, as a result of the score line being formed therebetween. Similarly, end flap 61 includes an end wall portion 65 and an edge strip 67 separated therefrom by score line 69. The sleeve 24, including end flaps 60,61, is preferably formed from a single paperboard blank.

Figure 2:
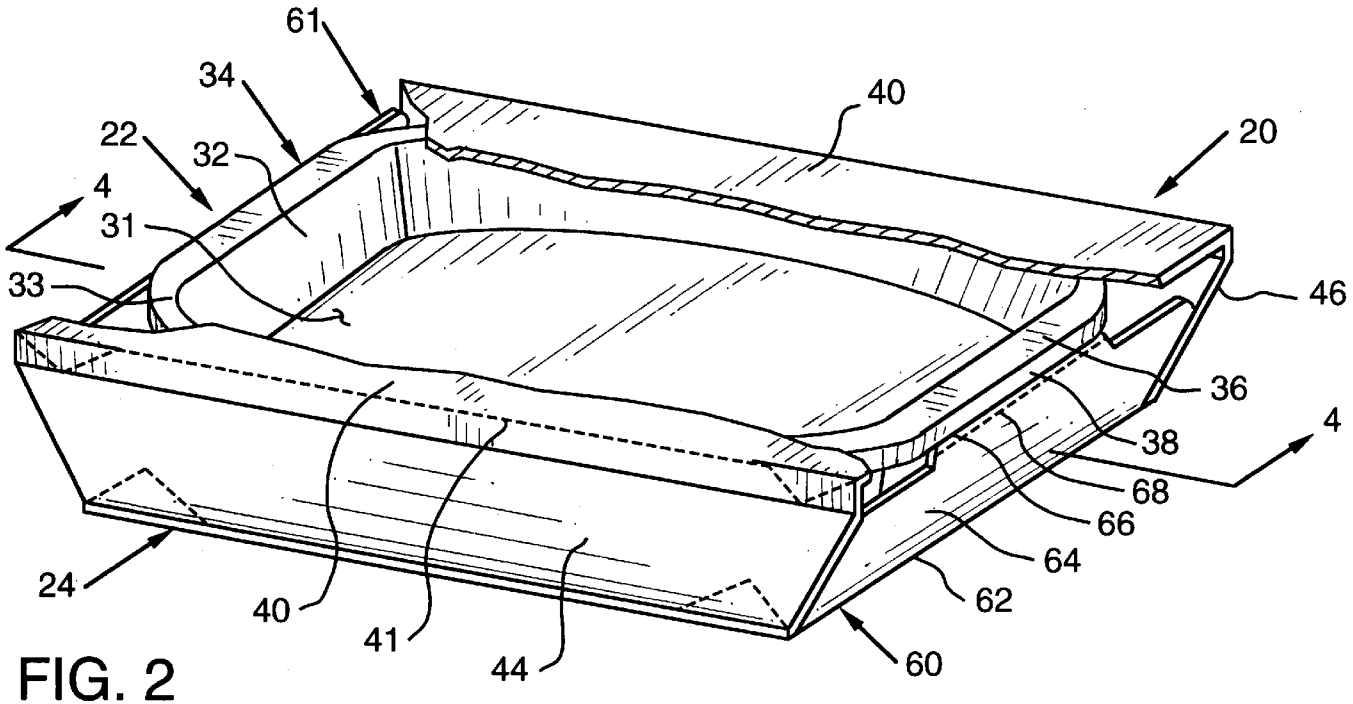
FIG. 2 is a perspective view, partially cut away, showing the food package of FIG. 1 as assembled.
Figure 3:
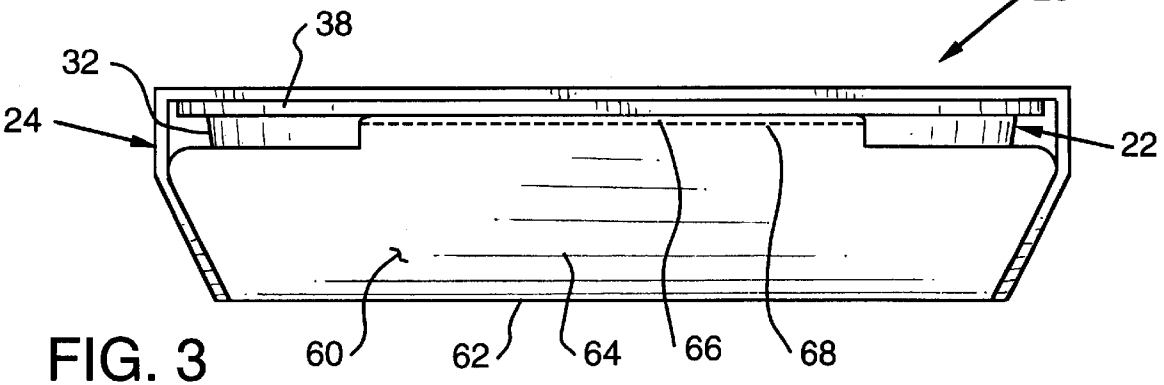
FIG. 3 is a side elevational view of the food package of FIG. 2.
Figure 4:
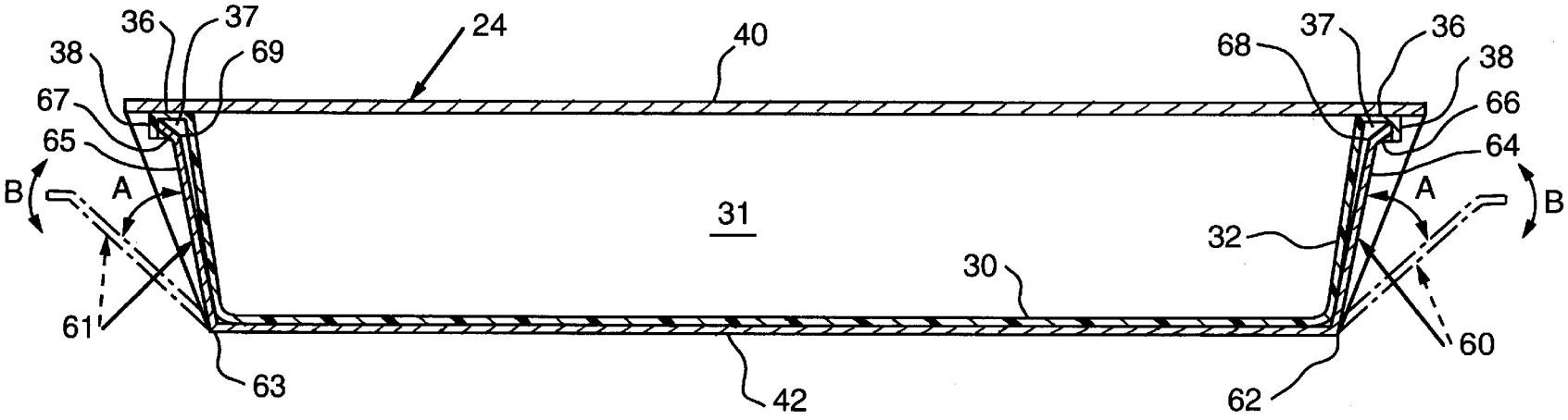
FIG. 4 is a sectional view taken along line 4—4 of FIG. 2.
Figure 5:
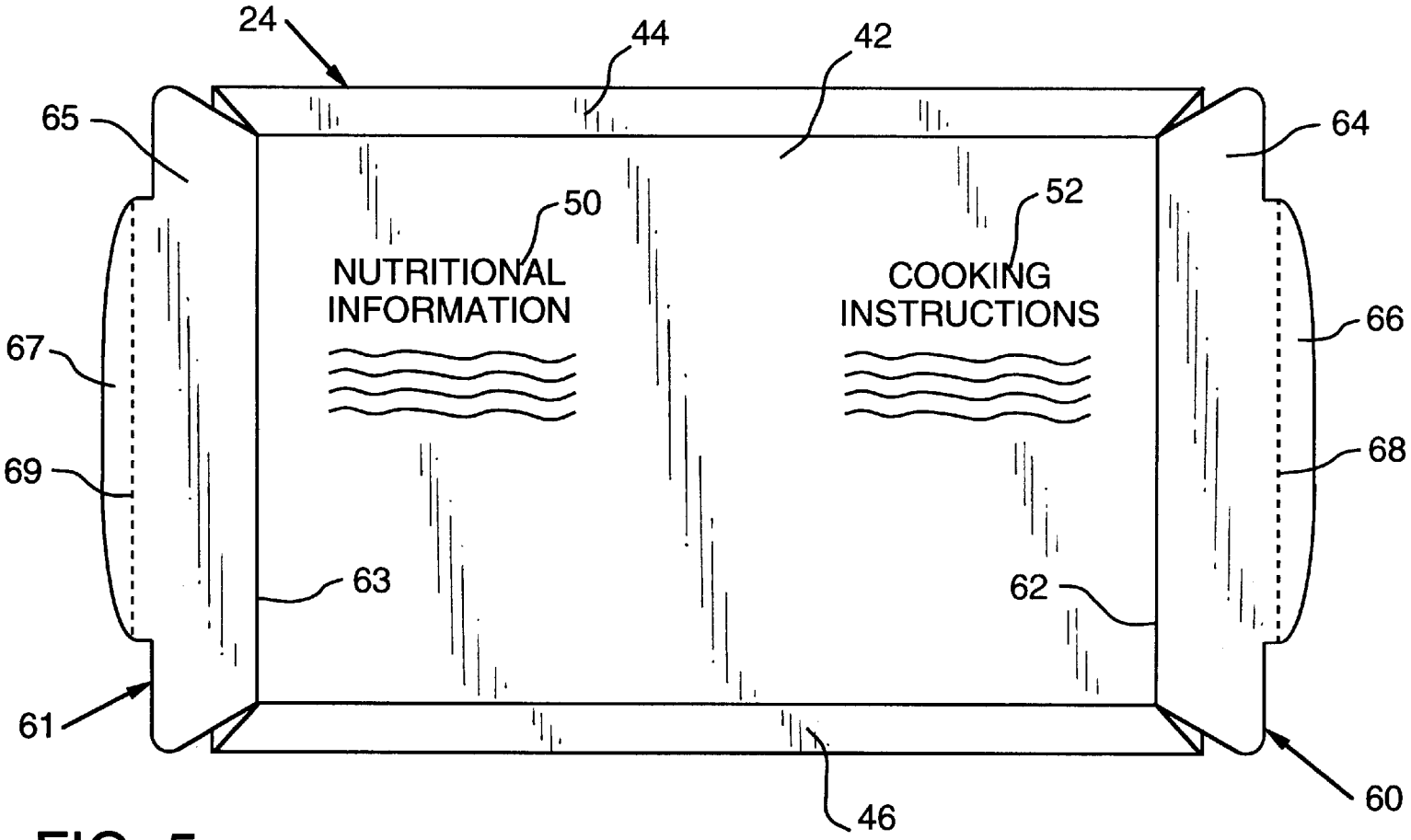
FIG. 5 is a bottom plan view of the sleeve only which is part of the food package of the present invention.

FIGS. 2–4 show the food package 20 as assembled with the tray 22 positioned within sleeve 24 (the front panel 40 is partially cut away in FIG. 2 in order to better show the food package 20 as assembled). As can be appreciated, the sleeve 24 is continuous and encircles the tray 22. The front panel 40 of sleeve 24 is disposed adjacent to the tray opening 31 of tray 22. Also, the back panel 44 of sleeve 24 is disposed adjacent the base 30 of tray 22.

In order to retain the tray 22 within sleeve 24, end flaps 60,61 of the sleeve 24 are mechanically secured to the flange 34 of tray 22. Specifically, as best shown in FIG. 4, the edge strip 66 of end flap 60 is received in space 37 defined by the first section 36 and second section 38 of flange 34 and is in contact with first section 36 and/or second section 38. End flap 60 is placed into contact with first section 36 and second section 38 by moving end flap 60 in the direction indicated by arrow A. The bend line 62 and score line 68 act in cooperation so as to allow end flap 60 to be positioned within flange 34. Specifically, bend line 62 allows for the end wall portion 64 of end flap 60 to be moved toward the sidewall 32 of tray 22. At the same time, edge strip 66 may be moved with respect to the end wall portion 64, as a result of score line 68 being formed therebetween, so that edge strip 66 may move beneath the second section 38 of flange 34. Once edge strip 66 clears the second section 38 of flange 34, edge strip 66 mechanically engages the flange 34 and becomes secured thereto. Specifically, edge strip 66 of end flap 60 is biased into engagement with first section 36 and second section 38 of flange 34. The biasing action is provided as a result of end flap 60 being connected to back panel 42 by bend line 60 and further is provided by the score line 68 formed between edge strip 66 and end wall portion 64.

In order to remove the tray 22 from sleeve 24, end flap 60 is removed from engagement with flange 34 by pushing end wall portion 64 inwardly so as to allow edge strip 66 to become disengaged from flange 34. End wall portion 64 is then moved in a direction away from sidewall 32 of tray 22 until the edge strip is positioned outside of first section 38 of flange 34.

End flap 61 is secured to tray 22 an removed from engagement therewith in the same manner.

It will be appreciated, therefore, that end flap 60,61 may be secured to flange 34 of tray 22 by placing edge strips 66,67 into engagement therewith and then be disengaged so that tray 22 may be removed from sleeve 24. This may be repeated as many times as may be necessary such as, for example, removing tray 22 from sleeve 24 so that the plastic film 39 may be removed or partially removed from tray 22 and then reinserting tray 22 within sleeve 24 for cooking.

The end flaps 60,61 of sleeve 24 also advantageously provide for improving the structural integrity of the food package 20, preventing crushing thereof when food packages 20 are stacked on top of each other. Once the end flaps 60,61 are secured to the tray 22, then the entire food package 20 becomes interconnected. This is important, for example, when considering how to place several of the food packages 20 into contact with one another such as, during shipment of the food packages or placement of the food packages on top of one another on food store shelves.

Figure 6:
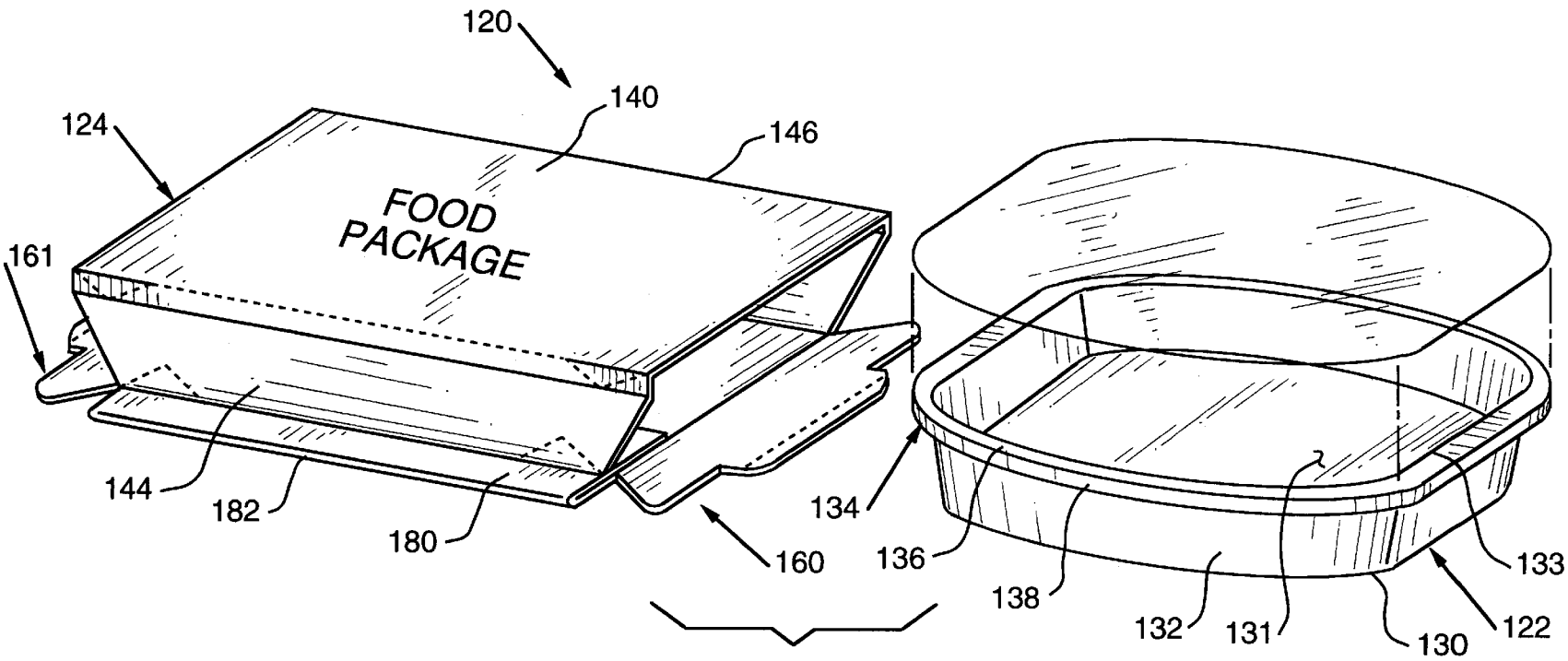
FIG. 6 is a perspective view of another embodiment of the present invention.
Figure 7:
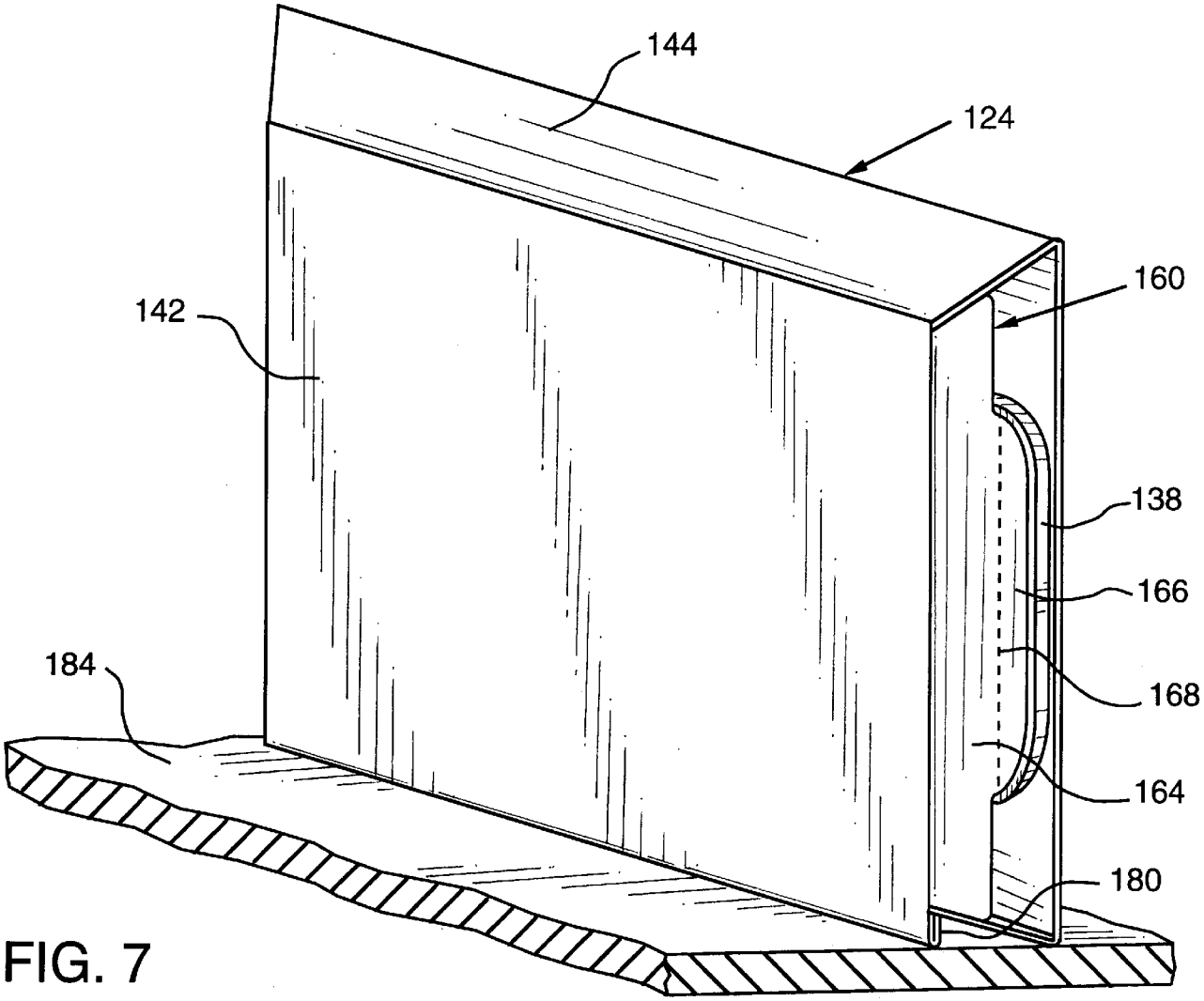
FIG. 7 is a perspective view showing the food package of FIG. 6 as assembled, and as would be "stood up" so that the display surface of the front panel is upright.

Referring to FIGS. 6 and 7, an additional embodiment of the present invention is shown. The food package 120 includes a tray 122 having a base 130 and a sidewall 132 extending therefrom and terminating in a free edge 133 which defines a tray opening 131. Tray 122 also includes a flange 134 comprised of a first section 136 extending generally perpendicularly from sidewall 132 and a second section 138 extending generally perpendicularly from first section 136. Plastic film 139 may be provided for covering the tray opening 131. As can be appreciated, tray 122 is substantially identical to tray 22 as described hereinabove.

Sleeve 124 includes front panel 140 and back panel 142. Sidewall members 144,146 are provided for extending between the front panel 140 and back panel 142. Sleeve 124 further includes end flaps 160,161 extending from the back panel 142. As can be appreciated, sleeve 124 is substantially similar to sleeve 24 as described herein above but includes the further feature of a rigid leg member 180 which will be described in more detail herein. Otherwise, the cooperation between tray 122 and sleeve 124, and particularly the cooperation between end flaps 160,161 and flange 134, is the same as previously described.

The rigid leg member 180 extends from the back panel 142 and includes a bottom edge 182 that is adapted to rest on a support surface 184 in order to position the front panel 140 substantially perpendicularly to the support surface 184. In this way, the front panel 140 can be advantageously displayed to potential consumers. Further details concerning the rigid leg member 80 are set forth in commonly owned U.S. patent application Ser. No. 08/883,062, filed Jun. 26, 1997 the disclosure of which is expressly incorporated by reference herein.

It will be appreciated that a food package has been disclosed which effectively provides for retaining a tray within a sleeve which is disposed thereabout. The sleeve includes one or more end flaps which are mechanically secured to the tray. The end flaps further provide improved structural integrity for the sleeve. The sleeve may also include a rigid leg member so that the food package may be "stood up".

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A food package comprising:

a tray including a base and a sidewall extending from said base, at least a portion of said sidewall having a flange extending therefrom; and a sleeve surrounding said tray, said sleeve including at least one end flap extending therefrom, said at least one end flap mechanically secured to said flange.

2. The food package of claim 1 wherein said sleeve includes a back panel disposed adjacent to said base; and said at least one end flap extends from said back panel.

3. The food package of claim 2 wherein said at least one end flap is separated from said back panel by a bend line.

4. The food package of claim 3 wherein said flange includes a first section extending generally perpendicularly from said side wall and a second section extending generally perpendicularly from said first section.

5. The food package of claim 4 wherein said at least one end flap includes an edge strip, said edge strip in engagement with said first and second sections of said flange.

6. The food package of claim 5 wherein said at least one end flap further includes an end wall portion, said edge strip separated from said end wall portion by a score line.

7. The food package of claim 2 wherein said back panel includes nutrition information and cooking instruction indicia printed thereon.

8. The food package of claim 1 wherein said sidewall extends from said base and terminates in a free edge, said free edge defining a tray opening.

9. The food package of claim 8 further including a plastic film secured to said free edge and covering said tray opening, said film being interposed between said tray and said sleeve.

10. The food package of claim 8 wherein said sleeve includes a front panel having a display surface, said front panel disposed adjacent said tray opening.

11. The food package of claim 10 wherein said sleeve includes a pair of opposed sidewall members each extending between said front panel and said back panel.

12. The food package of claim 10 further including a rigid leg member extending from said back panel, said rigid leg member having a bottom edge that can rest on a support surface in order to position said front panel substantially perpendicularly to said support surface, whereby said display surface can be better seen by potential customers.

13. The food package of claim 10 wherein said front panel includes food product identification indicia printed thereon.

14. The food package of claim 1 wherein said sleeve is formed from a single paperboard blank.

15. The food package of claim 1 wherein said tray is composed of a plastic.

16. The food package of claim 15 wherein said plastic is crystallized polyethylene terephlalate.

17. The food package of claim 15 wherein said plastic is amorphous polyethylene terephlalate.

18. The food package of claim 15 wherein said plastic is polypropylene.

19. The food package of claim 1 wherein said sleeve includes a tear strip.

20. The food package of claim 1 wherein said sleeve is continuous and encircles said tray.

* * * * *